US007467426B1

(12) United States Patent
Jarmon et al.

(10) Patent No.: US 7,467,426 B1
(45) Date of Patent: Dec. 23, 2008

(54) BODY SUPPORT AND METHOD FOR SUPPORTING A BODY

(76) Inventors: Robert G. Jarmon, 8 Brighton Ave., Spring Lake, NJ (US) 07662; Nicholas A. Jarmon, 8 Brighton Ave., Spring Lake, NJ (US) 07662

( * ) Notice: Subject to any disclaimer, the term of this patent is extended or adjusted under 35 U.S.C. 154(b) by 0 days.

(21) Appl. No.: 11/200,740

(22) Filed: Aug. 10, 2005

(51) Int. Cl.
*A47C 19/00* (2006.01)
*A61G 7/10* (2006.01)

(52) U.S. Cl. ..... 5/191; 5/88.1; 5/192; 5/933

(58) Field of Classification Search ..... 5/933, 5/81.1 R, 88.1, 191, 613, 944, 192, 600; 601/49, 601/98
See application file for complete search history.

(56) References Cited

U.S. PATENT DOCUMENTS 943,003 A * 12/1909 Cleaves ..... 5/88.1
1,273,599 A * 7/1918 Floyd ..... 5/88.1
3,126,553 A * 3/1964 Zastera et al. ..... 5/233
4,837,878 A * 6/1989 Huemer ..... 5/191
4,858,992 A * 8/1989 LaSota ..... 297/284.2
6,744,370 B1 * 6/2004 Sleichter et al. ..... 340/576

* cited by examiner

*Primary Examiner*—Patricia L Engle
*Assistant Examiner*—Jonathan J Liu
(74) *Attorney, Agent, or Firm*—Thomas L. Adams

(57) ABSTRACT

A body support for providing a beneficial effect has a frame and a first and a second plurality of flexible parallel bands, which are interdigitated. A primary shaft rotatably mounted in a frame can tighten and slacken the first plurality of bands. This can be done by having the shaft wind and unwind the first plurality of bands or by appropriately positioning a camshaft or the like at one edge of the body support surface to adjustably hold each of the first plurality of bands there. In the latter case the shaft provides a plurality of support locations at the first edge of the support surface that are moved, in order to alternately tighten and slacken the first plurality of bands. Other disclosed apparatus and methods can tighten and slacken the second plurality of bands as well.

13 Claims, 7 Drawing Sheets

BODY SUPPORT AND METHOD FOR SUPPORTING A BODY

BACKGROUND OF THE INVENTION

1. Field of the Invention

The present invention relates to beneficial body supports, and in particular, to supports having alternating elements.

2. Description of Related Art

Bedridden patients being treated in the hospital or at home can develop bedsores (decubiti) under certain conditions. The Braden Scale evaluates the risk of sores by scoring six categories: (1) The ability of the patient to respond meaningfully to pressure-related discomfort, which may decline as a result of sedation, a diminished level of consciousness, or a limited ability to feel pain. (2) The degree of exposure of the skin to moisture from perspiration, body fluids, etc. (3) The amount of physical activity performed by the patient. (4) The patient's ability to change and control body position. (5) The adequacy and quality of the patient's nutritional status. (6) How often the patient moves or must be moved in a way that causes friction and shear forces.

One of the prime contributors to skin breakdown that causes decubiti, is the build-up of moisture between the patient's skin and the bedding on which the patient is resting (Braden Scale).

Insensible water loss from a body is approximately 50 ml/hour ("*Textbook of Medical Physiology*" Guyton & Hall, 2000). When a patient is febrile, the amount of moisture exuded through the skin can increase dramatically. If the patient is also incontinent of bowel and/or bladder, more fluids are exuded and act to increase the damage of shear on skin, which promotes decubiti formation.

Existing hospital beds do not allow for free flow of air under the patient. One typically expensive model by Hill-Rom incorporates a mechanical flow of air but is predicated on existence of continual electrical power.

Keeping skin temperature down will also reduce the risk of decubiti. Unfortunately, known bedding systems do not incorporate effective features for reducing or moderating skin temperature.

The prediction of porosity or permeability of fabrics via theoretical models has proven somewhat frustrating (*The Relationship Between Porosity and Air Permeability of Woven Textile Fabrics*, Epps & Leonas, *Journal of testing and Evaluation*, Vol. 25, 1997, pp 108-113). Fortunately the measurement of air and moisture is not, and is available for the common fabrics (sheeting, print cloth, flannel, sateen, plain weave, batiste, poplin, and the synthetics: taffeta, challis, and plain weave triacetate).

Rather complicated beds are available for providing a body support that reduces the tendency for bedsores. These beds provide continually changing pressure points that prevent stasis. However, these beds are not widely available because their complexity and cost make them impractical for widespread use in most hospitals, as well as being beyond the financial reach of most home users. Moreover, these beds have many drawbacks in that they do not promote adequate air circulation around the patient, are not easily dismantled for set up or cleaning, cannot be easily operated manually during a power failure, etc.

In U.S. Pat. No. 5,083,551 three endless bands are looped around the seat of a wheelchair and are tightened and slackened by a single camshaft with three cam faces phased 120° apart.

In U.S. Pat. No. 4,155,592 straps 28 secured to the right edge of a seatback stretch across a frame from left to right and are routed past a camshaft 36. Rotation of camshaft 36 will selectively tighten some of the straps to adjust the lumbar support.

In U.S. Pat. No. 4,837,878 a bed is provided with stretchable straps alternating with non-stretchable straps. Strap tension can be adjusted mechanically, including by winding the strap around a rotatable shaft.

In U.S. Pat. No. 2,112,367 levers 35 on the right side of a bed frame attach to the right end of odd straps 29 while levers 35 on the left side attach to the left end of even straps. Levers on opposite sides are either moving toward or away from the middle to move the consecutive straps in opposite longitudinal directions.

In FIG. 32 of U.S. Pat. No. 5,862,550 a panel is slotted to provide a plurality of flexible bands, flexibility being enhanced by providing the U-shaped bands at 108 of FIG. 3. Cams on an underlying camshaft raise and lower alternate bands to avoid bedsores.

In U.S. Pat. No. 5,443,439 plates 11 can be tilted in different phases by a camshaft.

In U.S. Pat. No. 5,103,511 a sling-like cradle is automatically rocked back and forth to avoid bedsores.

In U.S. Pat. No. 4,459,712 a mesh can circulate on rollers 14,16, and 18. The height of roller 18 can be changed to adjust the sag in the top span of the mesh. See also U.S. Pat. No. 4,109,329.

In FIG. 5 of U.S. Pat. No. 5,109,558 a crank rocks levers 273 to vertically reciprocate the bed elements 205 to avoid bedsores. See also U.S. Pat. No. 5,626,555.

In U.S. Pat. Nos. 6,557,937 and 6,676,215 six slats form the seat of a wheelchair. A motor associated with each slat drives a crankshaft to vertically reciprocate its slat.

In U.S. Pat. No. 5,776,048 a burn patient lies on a row of fixed bars 38 interleaved with reciprocating bars 43. The reciprocating bars rise above and descend below the fixed bars to prevent bedsores. The bars have a removable core that can be removed for washing.

In U.S. Pat. No. 5,161,267 a patient is lifted by a number of parallel straps in order to change bed linens.

In U.S. Pat. No. 4,625,487 a number of transverse cushions are held in cradles to form a bed. Alternate cradles can be rocked in opposite directions to produce alternating lift points that can massage a person and prevent bedsores. See also U.S. Pat. No. 4,494,260 where cradled cushions are all rocked in the same direction.

In U.S. Pat. No. 3,464,406 a bed surface is supported by a number of parallel rods 100, each mounted between an opposite pair of planetary gears 90. The rods 100 are mounted eccentrically and at different phases so that when gears 9 are rotated, the rods produce a wave-like motion.

In FIG. 5 of U.S. Pat. No. 4,999,861 a bed surface is formed from a number of parallel slats 18 with rollers that ride on cams 64, which are phased to produce a wave-like motion. See also U.S. Pat. No. 4,202,326.

In U.S. Pat. No. 4,958,627 a bed is formed of a number of parallel wires 13. A motor-driven cam swings a lever 32 (FIG. 3) to periodically hit and lift the wires 13 as shown in the upper left portion of FIG. 2.

In U.S. Pat. No. 6,009,873 a pair of inflatable wedges are placed on opposite sides of a patient and held in place with encircling straps to maintain the patient's position.

In U.S. Pat. No. 4,769,864 a single, stationary bed frame is strung with a wire that crosses the bed multiple times in a serpentine path.

See also, U.S. Pat. Nos. 2,112,367; 5,233,712; 4,999,861; 5,659,910; and 5,626,555.

Accordingly, there is a need for an improved body support and method for supporting a body that can provide a beneficial effect, such as preventing bedsores.

SUMMARY OF THE INVENTION

In accordance with the illustrative embodiments demonstrating features and advantages of the present invention, there is provided a body support for providing a beneficial effect. The body support has a frame and a first and a second plurality of flexible parallel bands. The first plurality of bands is interdigitated with the second plurality of parallel bands. Also included is a primary shaft rotatably mounted in the frame for winding and unwinding the first plurality of bands in order to alternately tighten and slacken the first plurality of bands.

In accordance with another aspect of the present invention, there is provided a body support for providing a support surface with a first and a second edge for supporting a living body and providing a beneficial effect. The body support has a frame and a first plurality of flexible parallel bands, each reaching from a first to a second edge of the support surface. Also included is a second plurality of parallel bands. The first plurality of bands is interdigitated with the second plurality of parallel bands. The body support also includes a primary shaft rotatably mounted in the frame for alternately tightening and slackening the first plurality of bands. The shaft is positioned at the first edge of the support surface to hold each of the first plurality of bands at the first edge of the support surface.

In accordance with yet another aspect of the present invention, a method is provided that employs a first and second plurality of interdigitated parallel bands for supporting a body along a support surface and providing a beneficial effect. The method includes the step of winding and unwinding the first plurality of bands in order to alternately tighten and slacken the first plurality of bands.

In accordance with still yet another aspect of the present invention, a method is provided that employs a first and second plurality of interdigitated parallel bands for beneficially supporting a body at a support surface having a first and second edge. The method includes the step of supporting the first plurality of bands at a plurality of support locations at the first edge of the support surface. Another step is moving the plurality of support locations in order to alternately tighten and slacken the first plurality of bands.

By employing apparatus and methods of the foregoing type, a body can be supported in an improved fashion. In one embodiment a first plurality of flexible bands are attached to a right rail, and routed across a support surface and over a left rail before being wound onto a left shaft located below the left rail. A second plurality of flexible bands that interdigitate with the first plurality are attached to the left rail, and routed across the support surface and over the right rail before being wound onto a right shaft located below the right rail. Thus the left (right) shaft can wind and unwind the first (second) plurality of flexible bands to tighten and slacken them. Consequently, a person lying upon the flexible bands will be supported alternately by the first plurality and then by the second plurality of bands so that pressure is not continuously applied to discrete locations on the body in a way that promotes bedsores. In some embodiments the positions of the shafts and the rails can be reversed, so that the rails are below the winding shafts.

In other embodiments a right and a left shaft are mounted along the edges of the support surface with a right and left rail mounted below the two shafts. A first and a second plurality of flexible bands are attached to the right rail and routed over the two shafts before attaching to the left rail. In one case, one of the shafts is a camshaft with a number of cam tracks. The cam tracks are arranged into two groups having different phases. Accordingly, the cam can rotate to tighten the first plurality of bands while allowing the second plurality to slacken, and vice versa. In a second case, both shafts are camshafts, with one of the camshafts having cam tracks devoted to the first plurality of bands, and the cam tracks of the other camshaft devoted to the second plurality. The two camshafts are phased differently so that again the first plurality of bands are tightened while the second plurality is slackened, and vice versa. In the foregoing embodiments the rails can be eliminated and the ends of each of the bands connected together to form a number of endless loops.

BRIEF DESCRIPTION OF THE DRAWINGS

The above brief description as well as other objects, features and advantages of the present invention will be more fully appreciated by reference to the following detailed description of presently preferred but nonetheless illustrative embodiments in accordance with the present invention when taken in conjunction with the accompanying drawings, wherein.

DETAILED DESCRIPTION OF THE PREFERRED EMBODIMENTS

Figure 1:
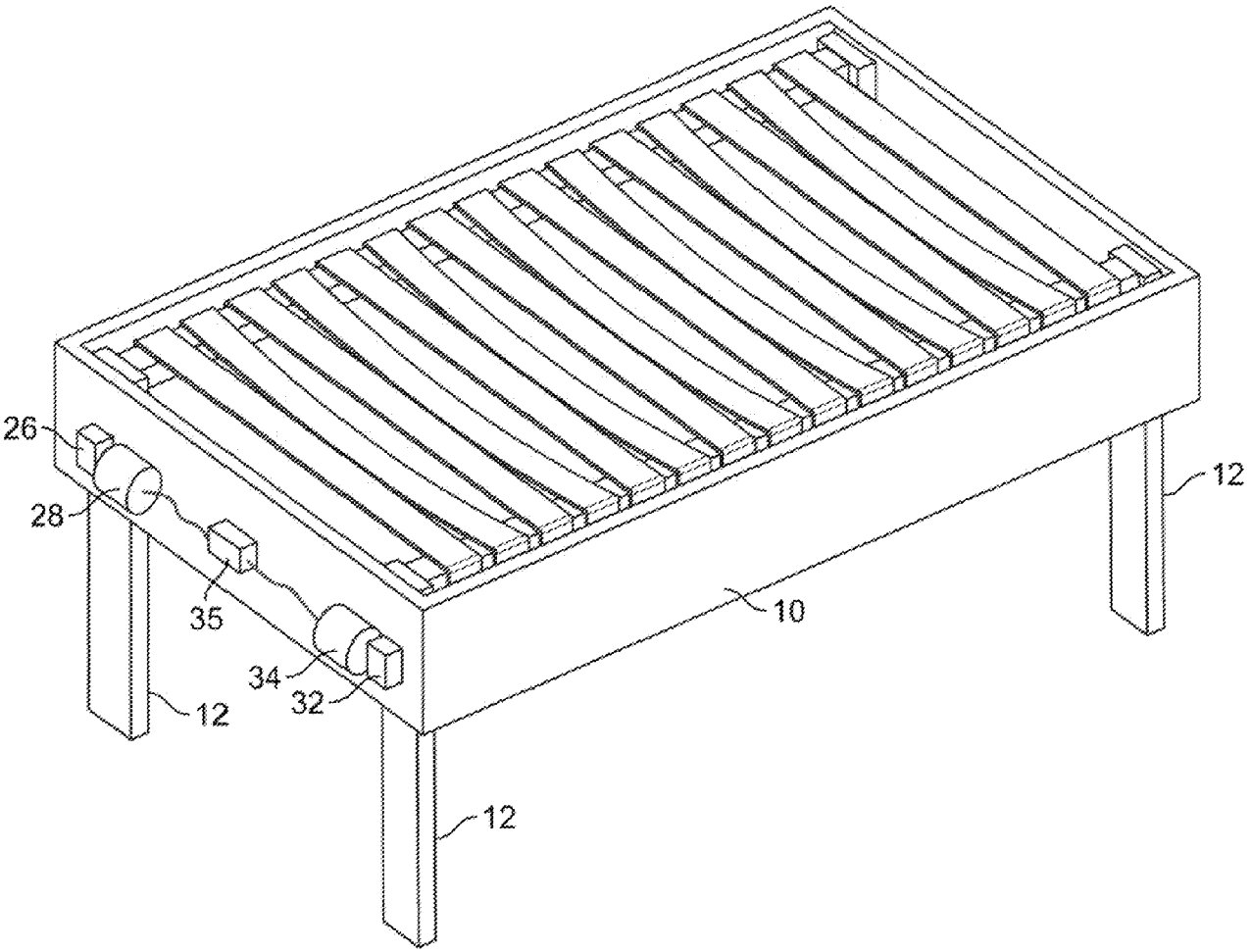
FIG. 1 is perspective view of the body support capable of performing a support method in accordance with principles of the present invention.
Figure 2:
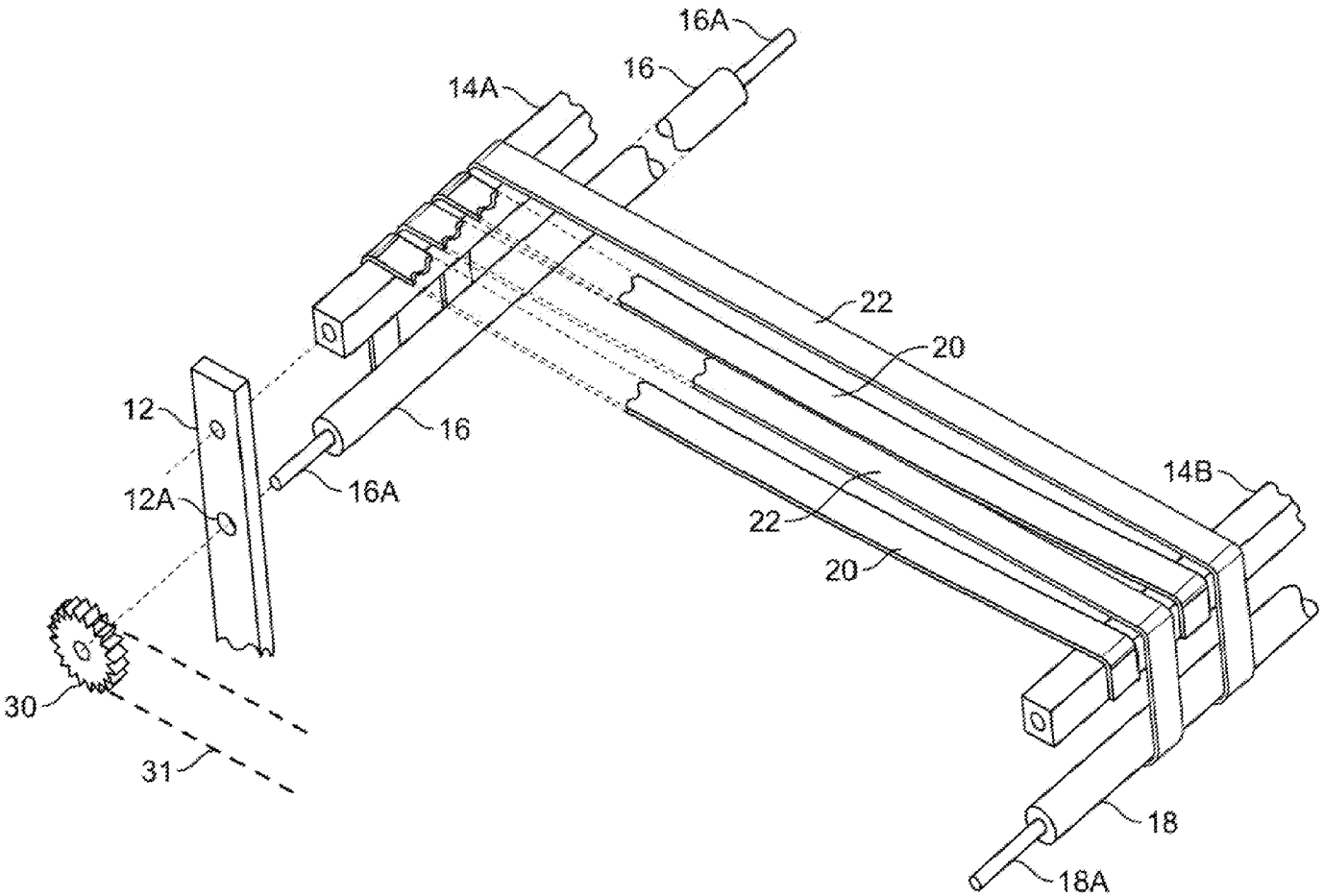
FIG. 2 is a perspective, exploded view of a portion of the structure of FIG. 1.

Referring to FIGS. 1 and 2, a body support is shown as a frame having a four-sided, open rectangular chassis 10 with four corner legs 12 attached to chassis 10 by welding, bolts, or other fastening means. An opposing pair of longitudinal rails 14A and 14B are likewise attached to legs 12 and constitute a right and left edge of a body support surface. A primary shaft 16 has on both ends a trunnion 16A that is journalled in a hole, for example 12A in leg 12. A similar shaft 18 (a secondary shaft) has trunnions, such as trunnion 18A, again designed to mount in holes, such as 12A in legs 12. Shaft 16 and 18 are mounted directly below shafts 14A and 14B, respectively.

A first plurality of parallel flexible bands 20 are routed over rails 14A and 14B with one end attached to the underside of rail 14B by snaps, clamps, screws or the like. The opposite ends of bands 20 are routed over rail 14A and are attached to the periphery of shaft 16 by screws, clamps, snaps, or the like. A second plurality of parallel flexible bands 22 are routed over rails 14A and 14B with one end attached to the underside of rail 14A by snaps, clamps, screws or the like. The opposite ends of bands 22 are routed over rail 14B and are attached to the periphery of shaft 16 by screws, snaps, clamps, or the like. It is advantageous to keep bands 20 and 22 easily removable for cleaning. In some cases the ends of the bands can have reinforced grommets that slip over hooks on rails and shafts. Alternatively, the ends of the bands can have stated into holes or loops on the rails and shafts.

The bands 20 and 22 may be cloth strips made of linen, canvas, or other fabrics made of natural or synthetic fibers. Alternatively, bands 20 and 22 may be continuous plastic strips or composite materials with a certain amount of elasticity. In still other embodiments, each of the bands 14 may be formed of a separate number of smaller strips or cords. In some embodiments, the bands may be formed of multiple layers that have different purposes; for example, an absorbent upper layer on top of a lower layer having a desired amount of strength and elasticity.

In most embodiments, the width of the bands will be between 0.5 to 12 inches (1.3 to 30.5 cm); but preferably the range will be 1 to 2 inches (2.5 to 5.1 cm). In any event, it is desirable to have bands that allow the passage of air, vapor and liquids to reduce the amount of moisture that can be trapped between a person's body and one of the bands.

To promote hygiene, bands 20 and 22 can be optionally covered with a strip of tape (such as Scotch 3M Safe-Release Painter's Masking Tape #2090, or Scotch 3M™ Tan Polyethylene Single Coated Medical Tape #1 523). In some embodiments the tape can be impregnated with an optional antibacterial, antiseptic or sanitizing agent to extend the life of the tape.

When such tape is used the bands 20 and 22 can be freshened by removing the tape should it become soiled and replacing it with clean tape, thereby reducing the need to wash the bands 20 and 22 every time there is a spill or a new patient. The staff in charge of maintaining the cleanliness of the bands 20 and 22 can make a judgment as to how many times and how frequently the strips will be replaced before washing the bands. For major spills or for environments where contamination or the spread of disease is the primary concern, the strips can be replaced more frequently. In some instances the optional strips will not be replaced except at the time of washing and thus will be discarded whenever the bands 20 and 22 are to be removed and washed.

Reducing the moisture at a patient's skin is highly desirable. Even in the absence of fluid excretion from incontinence or other such causes, perspiration can predispose the skin to decubiti development. This moisture is directly affected by the air permeability of the bands. Keeping air permeability greater than 9 $cm^3/cm^2/sec$ is desirable and, preferably, the air permeability will be greater than 50 $cm^3/cm^2/sec$. In one highly preferred embodiment, the bands are made of a plain weave of triacetate fibers or other synthetic fibers having an air permeability exceeding 130 $cm^3/cm^2/sec$, although the use of other types of fabrics is anticipated. Air permeability will be measured as described in *The Relationship Between Porosity and Air Permeability of Woven Textile Fabrics*, Epps & Leonas, *Journal of testing and Evaluation*, Vol. 25, 1997, pp 108-113.

The bands in the present arrangement can be of various strengths as needed without compromising moisture evaporation, or the effects of wicking or osmotic movement.

Also, since the bands are relatively permeable, thin, have small gaps between them, and alternate position, the overall air permeability is relatively high. Moreover, the same factors work to keep skin temperature down and therefore help to reduce the risk of decubiti.

Referring still to FIGS. 1 and 2, the trunnion 16A of shaft 16 connects through right angle gear box 26 to a driver 28 in the form of an electrical motor. Instead of an electric motor, some embodiments may employ a solenoid, stepper motor, hydraulic piston, etc. Trunnion 18A of shaft 18 connects in a similar fashion through right angle gear box 32 to another driver 34, which is the same as driver 28.

Drivers 28 and 34 can be operated sequentially by a controller 35 in the form of electronic timer. Alternatively, the controller 35 may employ a clock motor that slowly rotates a number of cams that operate switches to cause drivers 28 in 34 to operate in an appropriate sequence. Instead of operating electrical switches, an alternate controller can employ motor-driven cams that operate levers attached to shaft 16 and 18 to rotate them with an appropriate timing. In still other embodiments, shafts 16 and 18 can be operated manually by, for example, a hand crank.

An optional gear 30 can be mounted on trunnion 16A and linked by an optional endless chain 31 to a similar gear (not shown) on trunnion 18A. When employed, such gears and endless chain are referred to as a link mechanism. Accordingly, a single driver can rotate one of the gears 30 (or a separate driving gear (not shown) and engage chain 31) to cause the shafts 16 and 18 to reciprocate synchronously. Shaft 16 can then slacken bands 20 while shaft 18 tightens bands 22, and vice versa. As explained further hereinafter, linking the shafts 16 and 18 in this way may create an undesirable transition interval when all bands 20 and 22 are slackened somewhat.

Figure 3A:
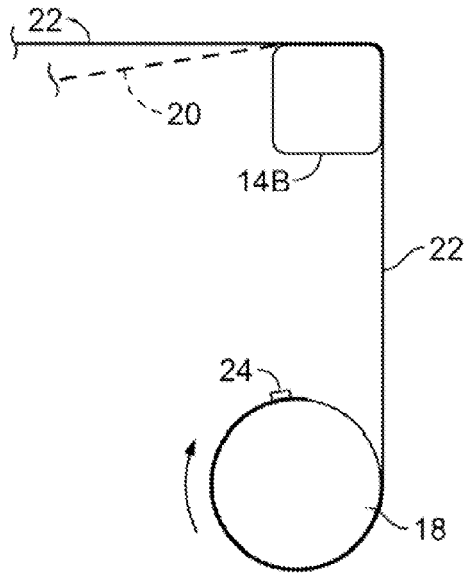
FIG. 3A is a free body diagram of components from FIG. 2 showing the winding and unwinding of bands in one phase.
Figure 3B:
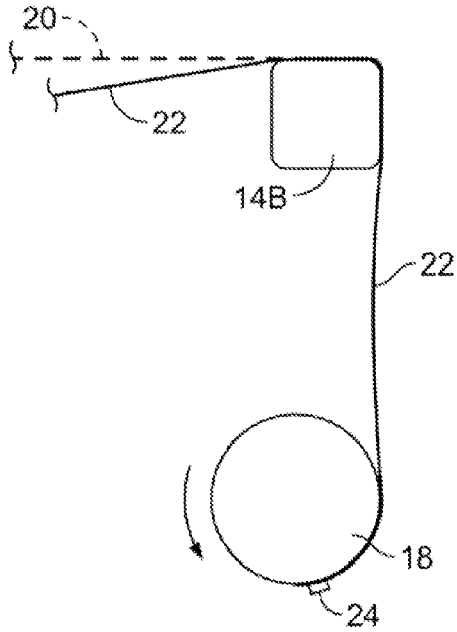
FIG. 3B is a free body diagram similar to that of FIG. 3A but showing the arrangement shifted into a different phase.

Referring to FIGS. 3A and 3B, previously mentioned band 22 is shown attached to shaft 18 by snap fastener 24. When shaft 18 is rotated clockwise as indicated in FIG. 3A, band 22 is pulled tight over rail 14B so its central section is approximately horizontal. When shaft 18 is rotated counterclockwise as indicated in FIG. 3B, band 22 slackens and effectively descends (the magnitude of descent is exaggerated in FIG. 3B). As explained further hereinafter, band 20 (shown in phantom) likewise tightens and slackens under the influence of shaft 16 (FIG. 2), but with a different phasing relative to band 22.

It is desirable to tighten and slacken bands 20 and 22 in the following sequence: (a) bands 20 tightened and bands 22 slackened; (b) bands 20 and 22 both tightened; and (c) bands 20 slackened and bands 22 tightened. With this sequencing a person supported by the bands 20 and 22 does not experience a sinking feeling that might otherwise occur if all bands slackened.

Figure 4A:
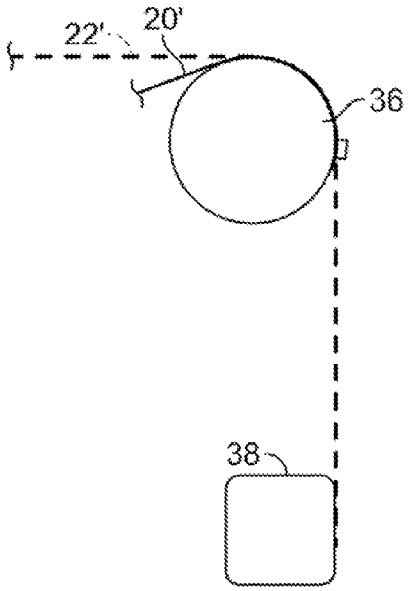
FIGS. 4A and 4B is a free body diagram showing an arrangement that is an alternate to that of FIGS. 3A and 3B, respectively.
Figure 4B:
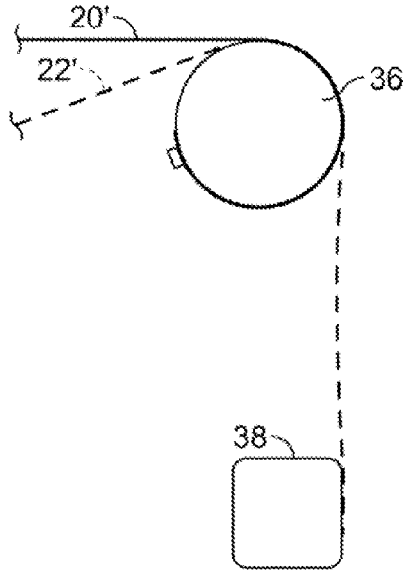

In the alternate embodiment of FIGS. 4A and 4B, the rails at the edge of the support surface are eliminated and replaced with winding shafts, such as winding shafts 36 shown winding the bands 20'. While only one edge is illustrated in these figures, it will be appreciated that a complementary winding shaft (not shown) exists at the opposite edge. In fact, bands 22', which are wound around this other complementary shaft, also slide over the illustrated shaft 36 and attach to rail 38. Rail 38 is similar to the previously illustrated rails (rails 14A and 14B in FIG. 2). It will be appreciated that a complementary rail (not shown) on the opposite side of the body support will be mounted below the other complementary winding shaft there. Bands 20' will slide over this other complementary winding shaft and terminate on this other complementary rail.

The foregoing shaft 36, rail 38, and the complementary shaft and rail will be mounted in a frame similar to that shown in FIGS. 1 and 2. As before, shaft 36 and the complementary shaft will be driven by a motor or other means.

Accordingly, winding shaft 36 can unwind bands 20' so they sag as shown in FIG. 4A. Shaft 36 can also wind bands 20' as shown in FIG. 4B so they tighten and become effectively horizontal. The other complementary shaft can wind can unwind bands 22' with a different phase to produce the same effect previously mentioned in connection with the embodiment of FIG. 1.

To facilitate an understanding of the principles associated with the foregoing apparatus, its operation will be briefly described in connection with the embodiment of FIGS. 1 and 2 (the operation for the embodiment of FIGS. 4A and 4B will be similar). A bed sheet may be placed on the body support of FIG. 1 over the bands 20 and 22. Thereafter, a patient may be placed on the bed sheet and will be supported by bands 20 and 22. Preferably, bands 20 and 22 will have a certain amount of elasticity so that the patient will be supported comfortably.

Initially, shaft 18 will be in the wound condition as shown in FIGS. 2 and 3A. Shaft 16 will be in an unwound condition as shown in FIG. 2. This unwound condition will be similar to the unwound condition shown in FIG. 3B for shaft 18. Therefore, as shown in FIG. 2, bands 20 will sag relative to bands 22. Therefore, support will be provided primarily by bands 22. Next, driver 28 (FIG. 2) will be operated through gear box 26 to rotate shaft 16 in order to wind bands 20. As a result, bands 20 and 22 will be at the same height and will simultaneously provide support. Therefore, a person lying on the bands will not experience a sinking feeling that might occur if all bands were slackened somewhat at the same time.

Once bands 20 are tightened, motor 28 will be stopped. Almost immediately thereafter, motor 34 will be operated through gear box 32 to rotate shaft 18 and slacken bands 22. Once bands 22 are sufficiently slackened, motor 34 will stop. Both motors 28 and 34 then remain off for a period of time. In fact, for the most part the motors remain off except for the transition when the bands 20 and 22 reverse their roles. At the next role reversal, shaft 18 will tighten bands 22 and stop before shafts 16 slackens bands 20 and then stops too.

Preferably, the repetition periods of the shafts 16 and 18 can be adjusted to accommodate the specific needs of the patient using the body support. The period can be adjusted to give bands 20 and 22 a period of five seconds to two hours.

Preferably, the space between adjacent ones of the bands 20 and 22 will be kept very small so that a person lying on the bands will not feel gaps. However, a small gap will be desirable to avoid having locations on the patient's body that always experience support pressure. Also, allowing a small gap will avoid pinching, but sheets or other covers can be placed over the bands to reduce or eliminate the risk of pinching as well.

When the bands 20 and 22 are tightened and slackened their central portion will effectively move up and down under the weight of the body on them. The vertical amplitude produced in the center of the bands 20 and 22 will be at least 0.5 inch (1.3 cm), and preferably in the range of 0.5 to 2.5 inches (1.3 to 6.4 cm). For example, with an amplitude of 0.5 inch one set of bands may rise 0.5 inch up to the patient resting level while the other set of bands descends to a position 0.5 inch below that resting level. The amplitude will be selected depending on the condition of the patient and the thickness and resiliency of any covers between the patient and the bands 20 and 22. In any event, the bands 20 and 22 will reciprocate in such a way as to the provide support from one set of bands while the other set of bands retracts just enough to take pressure off the patient.

Figure 5A:
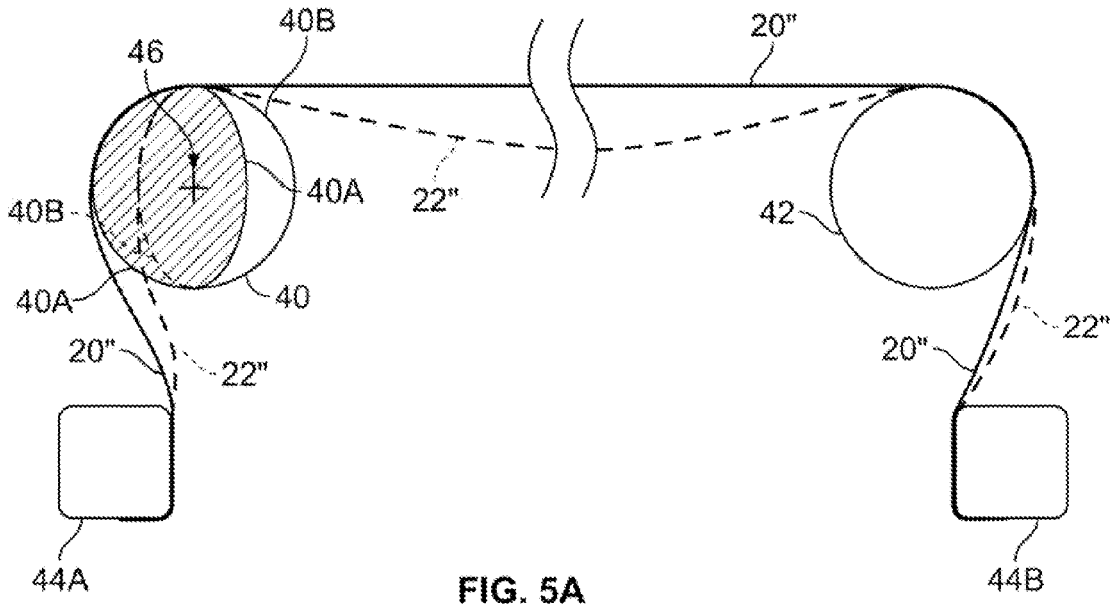
FIG. 5A is a schematic diagram of a portion of a body support that is an alternate to that of FIG. 1.
Figure 5B:
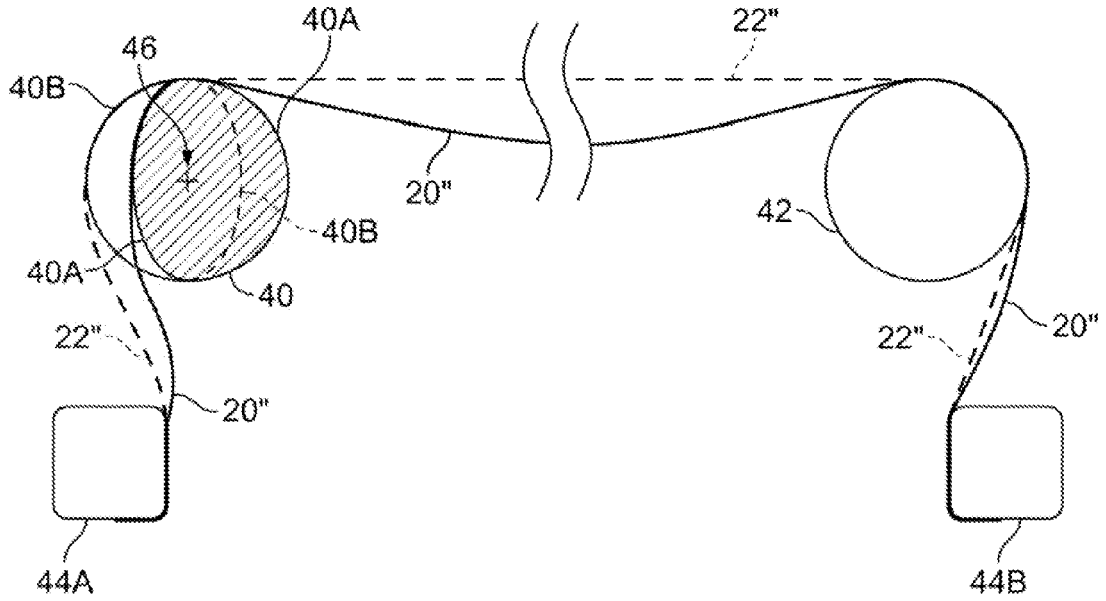
FIG. 5B is a schematic diagram similar to that of FIG. 5A but showing the arrangement shifted into a different phase.
Figure 6:
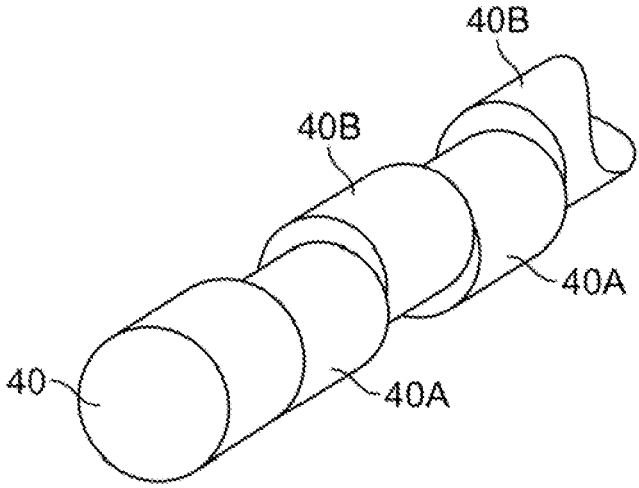
FIG. 6 is a perspective view of the camshaft of FIG. 5A.

Referring to FIGS. 5A, 5B, and 6, shafts 40 and 42 are rotatably mounted in a frame in a manner similar to that shown in FIGS. 1 and 2. Rails 44A and 44B are similar to the rails previously illustrated in FIG. 2 (rails 14A and 14B) and are mounted in a frame in a similar manner. In this embodiment a first plurality of bands 20" and a second plurality of bands 22" are suspended in an interdigitated manner, similar to the previously illustrated bands (bands 20 and 22 in FIG. 1). In particular, bands 20" and 22" are attached to rail 44A, are routed over shafts 40 and 42, and are attached to the opposite rail 44B. The bands 20" and 22" are not attached to shafts 40 and 42 and simply slide over them.

Primary shaft 40 is located at a first edge of a support surface, while shaft 42 is located at a second edge of the support surface. Shaft 42 is a simple cylindrical shaft, but shaft 40 is a camshaft having a first group 40A and second group 40B of cam tracks all rotating around center of rotation 46. Cam tracks 40A and 40B provide a plurality of support locations along the first edge of the body support. Bands 20" are arranged to ride over cam tracks 40A, while bands 22" ride over cam tracks 40B. Cam tracks 40A are the same as cam tracks 40B, except for having a first phase that is 180° out of phase with cam tracks 40B (which are deemed to offer a second phase).

With the angular orientation shown in FIG. 5A, the inwardly facing portion of cam tracks 40A are retracted but do not engage bands 20". Therefore, bands 20" ride over the unretracted portion of cam tracks 40A and remain tight. The outwardly facing portion of cam tracks 40B are retracted along an interval interfacing with bands 22", so these bands are slackened.

With the angular orientation shown in FIG. 5B, the inwardly facing portions of cam tracks 40B are retracted but do not engage bands 22". Therefore, bands 22" ride over the unretracted portion of cam tracks 40B and remain tight. The outwardly facing portions of cam track 40A are retracted along an interval interfacing with bands 20", so these bands are slackened.

The bands 20" and 22" can be alternately tightened and slackened by rotating camshaft 40 continuously for intermittently in either the clockwise or counterclockwise direction. Alternatively, the camshaft 40 can be reciprocated ±180° either with continuous oscillatory motion or by a rapid shifting between discrete positions between relatively quiescent intervals. Shaft 42 can be either non-rotative, arranged for freewheeling rotation, or driven to rotate with the same cycle or anticyclically.

Figure 8:
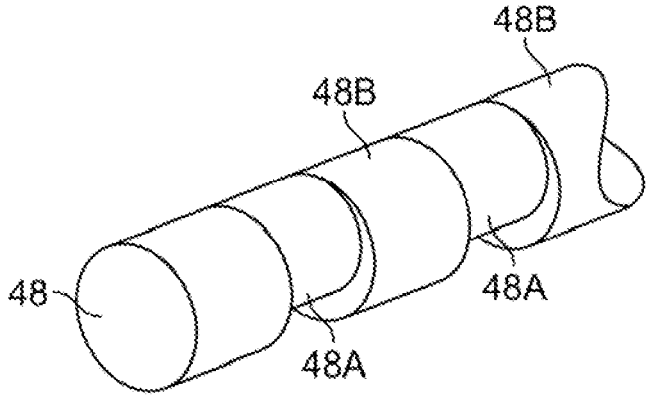
FIG. 8 is a perspective view of one of the camshafts of FIG. 7A.
Figure 7A:
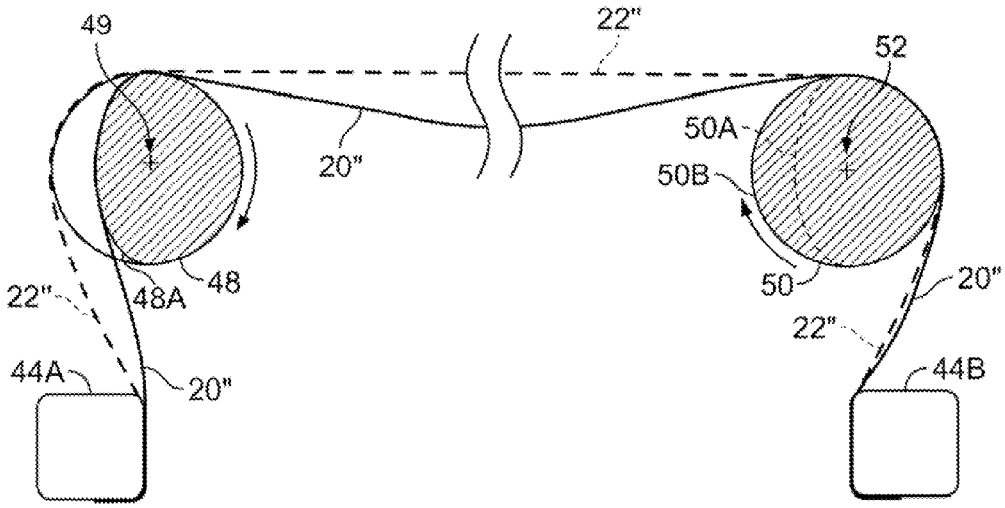
FIG. 7A is a schematic diagram of a portion of a body support that is an alternate to those mentioned above.
Figure 7B:
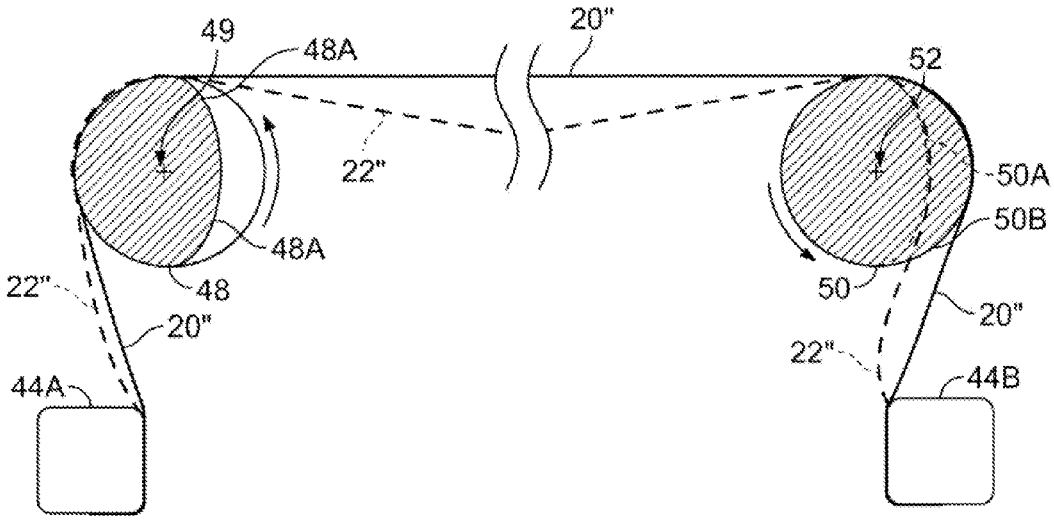
FIG. 7B is a schematic diagram similar to that of FIG. 7A but showing the arrangement shifted into a different phase.

Referring to FIGS. 7A, 7B, and 8, components identical to those described in previous illustrations bear the same reference numerals. Shafts 48 and 50 are rotatably mounted in a frame in a manner similar to that shown in FIGS. 1 and 2. Rails 44A and 44B are similar to the rails previously illustrated in FIG. 2 (rails 14A and 14B) and are mounted in a frame in a similar manner. In this embodiment a first plurality of bands 20" and a second plurality of bands 22" are suspended in an interdigitated manner, similar to the previously illustrated bands (bands 20 and 22 in FIG. 1). In particular, bands 20" and 22" are attached to rail 44A, are routed over shafts 48 and 50, and are attached to the opposite rail 44B. The bands 20" and 22" are not attached to shafts 48 and 50 and simply slide over them.

Primary shaft 48 with a center of rotation 49 is located at a first edge of a support surface, while secondary shaft 50 with a center of rotation 52 is located at a second edge of the support surface. Shafts 48 and 50 are camshafts having cam tracks 48A and 50A, respectively. Cam tracks 48A provide a plurality of support locations along the first edge of the body support, while cam tracks 50A provide a plurality of support positions along the second edge of the body support. Located between cam tracks 48A and 50A are concentric cylindrical portions 48B and 50B. Bands 20" are arranged to ride over cam tracks 48A and concentric portions 50B, while bands 22" ride over cam tracks 50A and concentric portions 48B. Camshaft 48 is the same as camshaft 50, except for having been installed with its cam tracks 48A in a first phase that is 180° out of phase with cam tracks 50A (which are deemed to offer a second phase).

With the angular orientation shown in FIG. 7A, the inwardly facing portions of cam tracks 50A are retracted but do not engage bands 22". Therefore, bands 22" ride over the unretracted portions of cam tracks 50A and remain tight. Note that the cylindrical, concentric portions 48B engaging bands 22" are radially invariant and do not affect the tension in bands 22". The outwardly facing portions of cam tracks 48A are retracted along an interval interfacing with bands 20", so these bands are slackened. Again, the cylindrical, concentric portions 50B of shaft 50 engaging bands 20" are radially invariant and do not affect the tension in bands 22".

With the angular orientation shown in FIG. 7B, the inwardly facing portions of cam tracks 48A are retracted but do not engage bands 20". Therefore, bands 20" ride over the unretracted portion of cam tracks 48A and remain tight. Note that the cylindrical, concentric portions 50B engaging bands 20" are radially invariant and do not affect the tension in bands 20". The outwardly facing portions of cam tracks 50A are retracted along an interval interfacing with bands 22", so these bands are slackened. Again, the cylindrical, concentric portions 48B engaging bands 22" are radially invariant and do not affect the tension in bands 20".

The bands 20" and 22" can be alternately tightened and slackened by rotating camshafts 48 and 50 continuously or intermittently in either the same or opposite direction. Alternatively, the camshafts 48 and 50 can be reciprocated ±180° either with continuous oscillatory motion or by a rapid shifting between discrete positions between relatively quiescent intervals.

In one embodiment camshafts 48 and 50 may be oriented as shown in FIG. 7A with bands 20" slack and bands 22" tight. Thereafter, camshaft 48 can rotate 180° (either clockwise or counterclockwise) while camshaft 50 remains stationary. Consequently, camshaft 48 will have the orientation shown in FIG. 7B and camshaft 50 will have the orientation shown in FIG. 7A so both bands 20" and 22" will be tight. Next, camshaft 50 can rotate 180° (either clockwise or counterclockwise) while camshaft 48 remains stationary. Consequently, camshafts 48 and 50 will have the orientation shown in FIG. 7B so that bands 20" will be tight and bands 22" slack. The foregoing cycle avoids an interval where both bands 20" and 22" are slackened somewhat to give the undesirable feeling of descent.

Figure 9A:
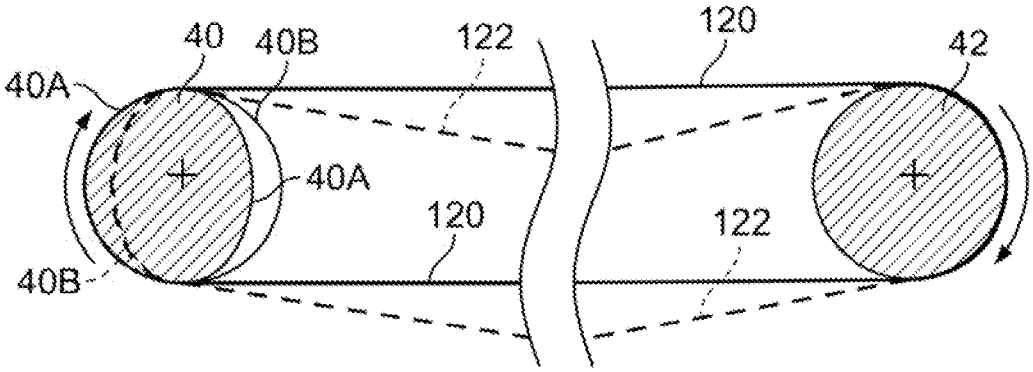
FIG. 9A is a schematic diagram of a portion of a body support that is an alternate to those mentioned above.
Figure 9B:
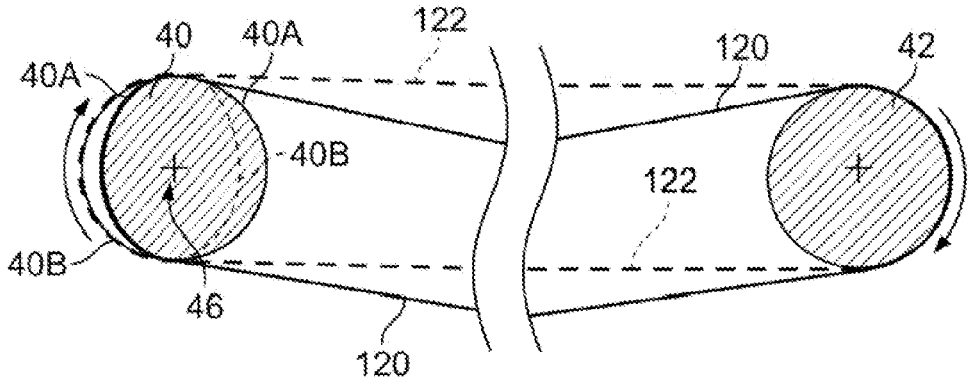
FIG. 9B is the schematic diagram of FIG. 9A showing the arrangement shifted into a different phase.

Referring to FIGS. 9A and 9B, components identical to those described in previous illustrations bear the same reference numerals. In particular, shafts 40 and 42 are identical to that shown in FIGS. 5A, 5B, and 6, and shaft 40 again provides a plurality of support locations. Shafts 40 and 42 are again rotatably mounted in a frame in a manner similar to that shown in FIGS. 1 and 2. In this embodiment a first plurality of bands 120 and a second plurality of bands 122 are all endless. Bands 120 and bands 122 are suspended in an interdigitated manner, similar to the previously illustrated bands (bands 20 and 22 in FIG. 1). In particular, bands 120 and 122 are not attached to shafts 40 and 42 and simply ride over them.

Primary shaft 40 is located at a first edge of a support surface, while shaft 42 is located at a second edge of the support surface. Shaft 42 is a simple cylindrical shaft, but shaft 40 is a camshaft as shown in FIG. 6. Bands 120 are arranged to ride over cam tracks 40A, while bands 122 ride over cam tracks 40B. Cam tracks 40A are the same as cam tracks 40B, except for exhibiting a first phase that is 180° out of phase with cam tracks 40B (which are deemed to offer a second phase).

With the angular orientation shown in FIG. 9A, the inwardly facing portion of cam tracks 40A are retracted but do not engage bands 120. Therefore, bands 120 ride over the unretracted portion of cam tracks 40A and remain tight. The outwardly facing portion of cam tracks 40B are retracted along an interval interfacing with bands 122, so these bands are slackened.

With the angular orientation shown in FIG. 9B, the inwardly facing portions of cam tracks 40B are retracted but do not engage bands 122. Therefore, bands 122 ride over the unretracted portion of cam tracks 40B and remain tight. The outwardly facing portions of cam track 40A are retracted along an interval interfacing with bands 120, so these bands are slackened.

The bands 120 and 122 can be alternately tightened and slackened by rotating camshaft 40 continuously or intermittently in either the clockwise or counterclockwise direction. Alternatively, the camshaft 40 can be reciprocated ±180° either with continuous oscillatory motion or by a rapid shifting between discrete positions between relatively quiescent intervals. Shaft 42 can be arranged for freewheeling rotation, or driven to rotate synchronously with shaft 40.

Figure 10A:
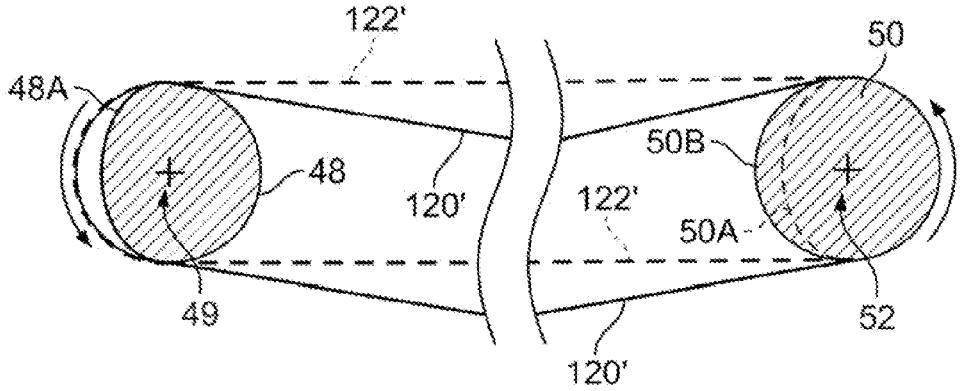
FIG. 10A is a schematic diagram of a portion of a body support that is an alternate to those mentioned above.
Figure 10B:
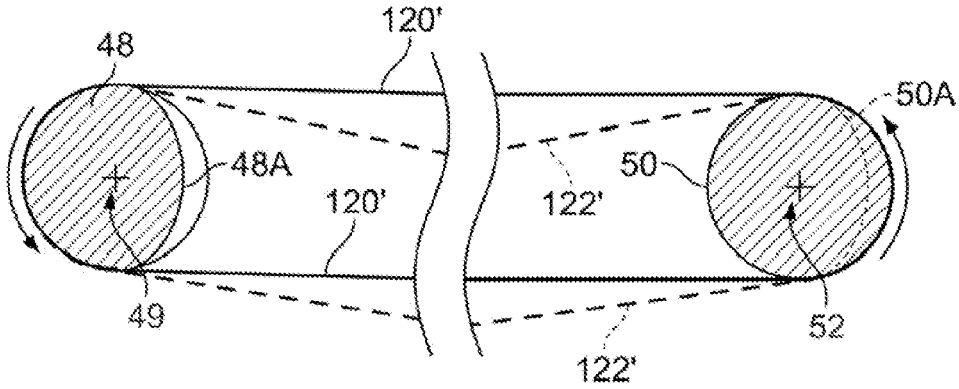
FIG. 10B is the schematic diagram of FIG. 10A showing the arrangement shifted into a different phase.

Referring to FIGS. 10A and 10B, components identical to those described in previous illustrations bear the same reference numerals. In particular, shafts 48 and 50 are identical to that shown in FIGS. 7A, 7B, and 8 (in particular, shafts 48 and 50 provide a plurality of support locations and a plurality of support positions). Shafts 48 and 50 are rotatably mounted in a frame in a manner similar to that shown in FIGS. 1 and 2. In this embodiment a first plurality of bands 120' and a second plurality of bands 122' are all endless. Bands 120' and bands 122' are suspended in an interdigitated manner, similar to the previously illustrated bands (bands 20 and 22 in FIG. 1). The bands 120' and 122' are not attached to shafts 48 and 50 and simply ride over them.

Primary shaft 48 with a center of rotation 49 is located at a first edge of a support surface, while secondary shaft 50 with a center of rotation 52 is located at a second edge of the support surface. Shafts 48 and 50 are camshafts having cam tracks 48A and 50A, respectively, as shown in FIG. 8. Bands 120' are arranged to ride over cam tracks 48A and concentric portions 50B, while bands 122' ride over cam tracks 50A and concentric portions 48B. Camshaft 48 is the same as camshaft 50, except for having been installed with its cam tracks 48A in a first phase that is 180° out of phase with cam tracks 50A (which are deemed to offer a second phase).

With the angular orientation shown in FIG. 10A, the inwardly facing portions of cam tracks 50A are retracted but do not engage bands 122'. Therefore, bands 122' ride over the unretracted portions of cam tracks 50A and remain tight. Note that the cylindrical, concentric portions 48B (FIG. 8) engaging bands 122' are radially invariant and do not affect the tension in bands 122'. The outwardly facing portions of cam tracks 48A are retracted along an interval interfacing with bands 120', so these bands are slackened. Again, the cylindrical, concentric portions 50B of shaft 50 engaging bands 120' are radially invariant and do not affect the tension in bands 120'.

With the angular orientation shown in FIG. 10B, the inwardly facing portions of cam tracks 48A are retracted but do not engage bands 120'. Therefore, bands 120' ride over the unretracted portion of cam tracks 48A and remain tight. Note that the cylindrical, concentric portions 50B engaging bands 120' are radially invariant and do not affect the tension in bands 120'. The outwardly facing portions of cam tracks 50A are retracted along an interval interfacing with bands 122', so these bands are slackened. Again, the cylindrical, concentric portions 48B engaging bands 122' are radially invariant and do not affect the tension in bands 120'.

The bands 120' and 122' can be alternately tightened and slackened by rotating camshafts 48 and 50 continuously or intermittently in either the clockwise or counterclockwise direction. Alternatively, the camshafts 48 and 50 can be reciprocated ±180° either with continuous oscillatory motion or by a rapid shifting between discrete positions between relatively quiescent intervals.

The four embodiments of FIGS. 5A, 5B, 7A, 7B, 9A, 9B, 10A, and 10B can produce the same effect as described in connection with the embodiment ins of FIGS. 1,2, 3A, 3B, 4A and 4B. Therefore, it will be appreciated that the operation described in connection with all of these embodiments will be essentially the same, or can be designed to operate essentially the same.

It is appreciated that various modifications may be implemented with respect to the above described, preferred embodiments. The foregoing structure may be used to construct a bed on which an individual can recline or sleep. Alternatively the foregoing structure can be adapted to produce a seat for a wheelchair, a bench (for one or more persons), or other chair. In still other embodiments, a pair of supports of the foregoing type can be arranged end to end with one of them having an adjustable angle of orientation to simulate a bed with an adjustable head. Also the various components described herein can be made of metal, wood, ceramics, composite materials, or other materials having an appropriate strength, flexibility, stability, etc. Furthermore, the dimensions and shapes of the various components can be altered depending upon the desired size, capacity, strength, degree of motion, etc. In addition, the foregoing structure can be supported in various ways including open or closed frames, free columns that are supported from below, one or more continuous panels, etc. Moreover, the support structure can be relatively short and be designed for placement inside a larger frame in much the way a mattress and box spring may be placed inside a bed frame. Also, in some embodiments the power for reciprocating the bands can be from utility power, emergency power, battery power (either normal or backup), and the like. While the foregoing embodiments showed two alternately phased groups of parallel bands, other embodiments may employ three or more groups, in which case then the individual groups will have individual phases (i.e., three or more alternating phases) produced by appropriately configured cams, controllers, etc.

Obviously, many modifications and variations of the present invention are possible in light of the above teachings. It is therefore to be understood that within the scope of the appended claims, the invention may be practiced otherwise than as specifically described.

The invention claimed is:

1. A therapeutic body support for providing body pressure that spatially varies with a spatial repeat comprising:

a frame;

a first plurality of flexible parallel bands each having an attached end attached to said frame;

a second plurality of flexible parallel bands, said first plurality of bands being interleaved with said second plurality of parallel bands;

a single primary shaft rotatably mounted in said frame and mechanically linked to said first plurality of bands away from said attached ends for mechanically engaging all of said first plurality of bands and not any of said second plurality of bands and for providing from the first plurality of bands a spatially varying pressure that varies with a spatial repeat; and a driver coupled to said single shaft to rotate it in order to induce alternate tightening and slackening of all of said first plurality of bands in unison and with a period appropriate for preventing a debilitating condition such as bedsores.

2. A body support according to claim 1 comprising:

a secondary shaft rotatably mounted in said frame for winding and unwinding said second plurality of bands and not said first plurality of bands in order to alternately tighten and slacken said second plurality of bands in unison.

3. A body support according to claim 2 wherein said primary shaft and said secondary shaft are located on opposite sides of said frame.

4. A body support according to claim 2 comprising:

an opposing pair of rails mounted in said frame at a higher elevation than said primary shaft and said secondary shaft, said first and said second plurality of bands being routed over said rails.

5. A body support according to claim 2 wherein said driver comprises:

at least one driver coupled to one or more of said primary shaft and said secondary shaft for rotating them in alternating phases in order to slacken and tighten (a) the first plurality of bands with one phasing, and (b) the second plurality of bands with an opposite phasing.

6. A body support according to claim 5 comprising:

a link mechanism coupled to said primary shaft and said secondary shaft for rotating them in alternating phases in order to slacken and tighten (a) the first plurality of bands with one phasing, and (b) the second plurality of bands with an opposite phasing.

7. A body support according to claim 2 wherein said driver comprises:

a pair of drivers separately coupled to corresponding ones of said primary shaft and said secondary shaft for rotating them in alternating phases in order to slacken and tighten (a) the first plurality of bands with one phasing, and (b) the second plurality of bands with an opposite phasing.

8. A body support according to claim 1 wherein said driver is coupled to said primary shaft for automatically rotating it in alternating directions.

9. A therapeutic method employing a frame with a first and second plurality of interleaved parallel bands for supporting a body along a support surface and varying body pressure via a single primary shaft that is mechanically linked to all of said first plurality of bands and none of said second plurality of bands, an attached end of each of said first plurality of bands being attached to said frame, the method comprising the steps of:

rotating said shaft with a driver in order to adjust said first plurality of bands in unison in order to induce alternate tightening and slackening of said first plurality of bands simultaneously giving them (a) tightness varying from that of said second plurality of bands, and (b) a spatially varying pressure that varies with a spatial repeat, said first plurality of bands being adjusted periodically with a period appropriate for preventing a debilitating condition such as bedsores.

10. A method according to claim 9 comprising the step of:

winding and unwinding said second plurality of bands in order to alternately tighten and slacken said second plurality of bands with a timing that is different than for tightening and slackening of said first plurality of bands.

11. A method according to claim 9 wherein the first plurality of bands are wound and unwound at a side of the support surface that is opposite of where the second plurality of bands are wound and unwound.

12. A method according to claim 9 employing a pair of rails on opposite sides of said support surface, comprising the step of:

routing the first plurality of bands over at least one of said pair of rails, the step of winding and unwinding the first plurality of bands being performed at an elevation below the pair of rails.

13. A method according to claim 9 comprising the step of:

winding and unwinding the second plurality of bands to alternately tighten and slacken them, the first and the second plurality of bands being wound and unwound in alternating phases in order to slacken and tighten (a) the first plurality of bands with one phasing, and (b) the second plurality of bands with an opposite phasing.

* * * * *